US008162711B2

(12) United States Patent
Hu et al.

(10) Patent No.: US 8,162,711 B2
(45) Date of Patent: Apr. 24, 2012

(54) FIELD EMISSION DISPLAY

(75) Inventors: Qiu-Hong Hu, Göteborg (SE); Latchezar Komitov, Göteborg (SE)

(73) Assignee: UVIS Light AB, Gothenburg (SE)

( * ) Notice: Subject to any disclaimer, the term of this patent is extended or adjusted under 35 U.S.C. 154(b) by 0 days.

(21) Appl. No.: 12/735,384

(22) PCT Filed: Dec. 18, 2008

(86) PCT No.: PCT/EP2008/010831

§ 371 (c)(1),
(2), (4) Date: Oct. 6, 2010

(87) PCT Pub. No.: WO2009/086895

PCT Pub. Date: Jul. 16, 2009

(65) Prior Publication Data

US 2011/0018427 A1 Jan. 27, 2011

(30) Foreign Application Priority Data

Jan. 11, 2008 (EP) ..... 08150191

(51) Int. Cl.
*H01J 63/04* (2006.01)

(52) U.S. Cl. ..... 445/49; 313/495

(58) Field of Classification Search ..... 313/495–497; 445/49–51

See application file for complete search history.

(56) References Cited

U.S. PATENT DOCUMENTS 6,628,053 B1 9/2003 Den et al.

(Continued)

FOREIGN PATENT DOCUMENTS

CN 1959896 A 5/2007

(Continued)

OTHER PUBLICATIONS

Lei Wei et al., "Application of ZnO nanopins as field emitters in a field-emission-display device" J. Vac. Sc. Technol. B, vol. 25, No. 2, Mar. 30, 2007, pp. 608-610.

(Continued)

*Primary Examiner* — Toan Ton
*Assistant Examiner* — Hana Featherly
(74) *Attorney, Agent, or Firm* — Harness, Dickey & Pierce, P.L.C.

(57) ABSTRACT

The present invention relates to a method for the manufacturing of a field-emission display (300), comprising the steps of arranging an electron-emission receptor (302) in an evacuated chamber, arranging a wavelength converting material (304) in the vicinity of the electron-emission receptor, and arranging an electron-emission source (100) in the evacuated chamber, the electron-emission source adapted to emit electrons towards the electron-emission receptor, wherein the electron-emission source is formed by providing a substrate, forming a plurality of ZnO-nanostructures on the substrate, wherein the ZnO-nanostructures each have a first end and a second end, and the first end is connected to the substrate, arranging an electrical insulation to electrically insulate the ZnO-nanostructures from each other, connecting an electrical conductive member to the second end of a selection of the ZnO-nanostructures, arranging a support structure onto of the electrical conductive member, and removing the substrate, thereby exposing the first end of the ZnO-nano structures. Advantages with the invention include for example increased lifetime of the field-emission display as there will be a smaller sections of the nanostructures that will be non-height-aligned. Furthermore, by not having to height align the nanostructures using an expensive etching, grinding, or similar method step, it is possible to achieve a less expensive end product. The present invention also relates to a corresponding field-emission display.

16 Claims, 3 Drawing Sheets

U.S. PATENT DOCUMENTS

| | | | | |
|---|---|---|---|---|
| 6,750,470 | B1 * | 6/2004 | Wilson | 257/10 |
| 2004/0209385 | A1 | 10/2004 | Liu et al. | |
| 2005/0127351 | A1 | 6/2005 | Tolt | |
| 2006/0226763 | A1 | 10/2006 | Moon et al. | |
| 2006/0284537 | A1 * | 12/2006 | Tolt | 313/306 |
| 2007/0103048 | A1 | 5/2007 | Liu et al. | |
| 2008/0315745 | A1 | 12/2008 | Den et al. | |

FOREIGN PATENT DOCUMENTS

| | | |
|---|---|---|
| EP | 0 913 508 | 5/1999 |

OTHER PUBLICATIONS

International Search Report.

First Notification of Office Action for corresponding Chinese patent application No. 200880124564.9 dated Jan. 11, 2012 (with English translation).

Lei Wei, et al., "Application of ZnO nanopins as field emitters in a field-emission-display device," J. Vac. Sci. Technol. B 25(2), Mar./Apr. 2007, pp. 608-610.

* cited by examiner

FIELD EMISSION DISPLAY

PRIORITY STATEMENT

This application is the national phase under 35 U.S.C. §371 of PCT International Application No. PCT/EP2008/010831 which has an International filing date of Dec. 18, 2008, which designates the United States of America, and which claims priority on European patent application number 08150191.8 filed Jan. 11, 2008, the entire contents of each of which are hereby incorporated herein by reference.

FIELD OF THE INVENTION

The present invention relates to a method for the manufacturing of a field emission display. The present invention also relates to a corresponding field emission display.

DESCRIPTION OF THE RELATED ART

Recently, there has been an aggressive development of new types of flat panel displays for use in conjunction with various electronic devices. The main focus is currently on liquid crystal displays (LCDs), plasma display panels (PDPs), and organic light-emitting diode displays (OLED displays). However, another promising approach is the use of the field emission technology for providing a display, namely a field emission display (FED).

A field emission display uses technology that is similar to the technology used in normal cathode ray tubes (CRTs), i.e. using a display panel coated with a phosphor layer as the light emissive medium that is bombarded by electrons emitted by a field emission electrode. However, a difference between a FED and a CRT is that the FED only is a few millimeters thick, and instead of using a single electron gun, a field emission display uses a large array of fine metal tips or carbon nanotubes, with many positioned behind each phosphor dot, to emit electrons through a process known as field emission. An advantage with FEDs in comparison with LCDs is that an FED do not display dead pixels like an LCD, even if 20% of the emitters fail. Furthermore, field emission displays are energy efficient and could provide a flat panel technology that features less power consumption than existing LCD and plasma display technologies, and can also be cheaper to make, as they have fewer total components.

An example of a field emission display and a method for the manufacturing of a field emission display is disclosed through US 2006/0226763, where the field emission device comprising a substrate, a cathode formed over the substrate, and an electron emitter electrically connected to the cathode. According to the disclosed field emission display, the electrode for emitting electrodes comprises carbon particles, for example in the form of a plurality of carbon tubes, carbon spheres, or similar.

However, using the disclosed method for forming the electrode does not provide an accurate alignment of the height of the carbon tubes constituting the electrode, as the carbon tubes are allowed to grow independently of each other, thus resulting in carbon tubes having different height. Different height of the independent carbon tubes leads to problems with obtaining homogeneous and stable electron emission, and for achieving a high current density. Including additional processing steps for aligning the height of the plurality of carbon tubes would not be desirable as such processing steps would lead to an expensive end product.

There is therefore a need for an improved field emission display that at least alleviates the problems according to prior art, and more specifically to a field emission display that has been adapted such that the prior art problems with height alignments relating to the field emission electrode are minimized.

SUMMARY OF THE INVENTION

According to an aspect of the invention, the above object is met by a method for the manufacturing of a field-emission display, comprising the steps of arranging an electron-emission receptor in an evacuated chamber, arranging a wavelength converting material in the vicinity of the electron-emission receptor, and arranging an electron-emission source in the evacuated chamber, the electron-emission source adapted to emit electrons towards the electron-emission receptor, wherein the electron-emission source is formed by providing a substrate, forming a plurality of ZnO-nanostructures on the substrate, wherein the ZnO-nanostructures each have a first end and a second end, and the first end is connected to the substrate, arranging an electrical insulation between and around the ZnO-nanostructures to electrically insulate them from each other, not fully covering the second end of the ZnO-nanostructures, connecting an electrical conductive member to the second end of a selection of the ZnO-nanostructures, arranging a support structure onto of the electrical conductive member, and removing the substrate, thereby exposing the first end of the ZnO-nanostructures.

In the context of this document, the term nanostructure is understood to mean a particle with one or more dimensions of 100 nanometers (nm) or less. The term nanostructures includes nanotubes, nanospheres, nanorods, nanofibers, and nanowires, where the nanostructures may be part of a nanonetwork. Furthermore, the term nanosphere means a nanostructure having an aspect ratio of at most 3:1, the term nanorod means a nanostructure having a longest dimension of at most 200 nm, and having an aspect ratio of from 3:1 to 20:1, the term nanofiber means a nanostructure having a longest dimension greater than 200 nm, and having an aspect ratio greater than 20:1, and the term nanowire means a nanofiber having a longest dimension greater than 1,000 nm.

Further definitions in relation to the nanostructures include the term aspect ratio, which means the ratio of the shortest axis of an object to the longest axis of the object, where the axes are not necessarily perpendicular. The term width of a cross-section is the longest dimension of the cross-section, and the height of a cross-section is the dimension perpendicular to the width. The term nanonetwork means a plurality of individual nanostructures that are interconnected. Also, the walls of the evacuated chamber can at least partly be consisting of the electron-emission receptor (for example coated by a wavelength converting material) and the electron-emission receptor. Furthermore, the evacuated chamber should be evacuated such that it is at low vacuum inside of the chamber for facilitating the emission of electrons from the electron source to the electron receptor.

The wavelength converting material preferably comprises at least one of a phosphor, a scintillator, and a mixture of phosphors and scintillators. A phosphor is a substance that exhibits the phenomenon of phosphorescence (sustained glowing after exposure to light or energized particles such as electrons). Similarly, a scintillator is a substance that absorbs high energy (ionizing) electromagnetic or charged particle radiation then, in response, fluoresces photons at a characteristic Stokes-shifted (longer) wavelength, releasing the previously absorbed energy. The present invention allows for the mixture of different phosphors and/or scintillators. Furthermore, the wavelength converting material may comprise a fluorescent material, organic fluorescent material, inorganic fluorescent material, impregnated phosphor, phosphor particles, phosphor material, YAG:Ce phosphor, or other material which can convert electromagnetic radiation into illumination and/or visible light.

In a prior art electrode, the first end of each of the plurality of nanostructures, are generally not height aligned, thus resulting in problems with obtaining homogeneous and stable electron emission when using the electrode in a field emission display, and/or for achieving a high current density. However, according to the invention, by forming the plurality of nanostructures on a substrate having a predefined surface configuration, and then use the end of the nanostructures that initially is connected to the substrate as an active emission end of the electrode (after that the substrate has been removed), it is possible to obtain a homogeneous and stable electron emission. This due to the fact that the first end of a majority of the nanostructures will be height aligned along a predefined line which results from the predefined surface configuration of the substrate.

Due to the height alignment characteristics of the nanostructures it can be possible to increase the lifetime of the field emission arrangement in which the field emission electrode according to the present invention is arranged, as there will be less of the nanostructures that will be non-height-aligned. The non-height-alignment present in a prior art field emission electrode led to a concentration of electron emission at the sections where the nanostructures are "extending closer" to an electron receptor adapted to receive electrons emitted by the field emission electrode. Furthermore, by not having to "height align" the nanostructures using an expensive prior art etching, grinding, or similar method step, it is possible to achieve a less expensive end product.

Furthermore, the use of ZnO has shown to be advantageous since the room temperature cathodoluminescence spectra of ZnO has a strong intensity peak at about 380 nm and has a 80% light content within +/−20 nm. As an extra feature the use of ZnO has shown excellent results when used as a cathode in a field emission display due to the possibility to grow ZnO nanostructures at relatively low temperatures. European Patent application 06116370 provides an example of such a method.

Preferably, the step of forming the plurality of nanostructures comprises the steps of arranging a plurality of metal or metal oxide nanoparticles on the substrate, and allowing for the plurality of metal or metal oxide nanoparticles to grow for forming the nanostructures. The metal or metal oxide nanoparticles can be formed/arranged using different methods known in the art. These methods include for example chemical vapor deposition (CVD), or one of its variants, such as plasma-enhanced chemical vapor deposition (PECVD). However, different methods can be contemplated. The same count for growing the nanoparticles. In the art different methods are known, including for example Vapor-Liquid-Solid (VLS) synthesis or a low-temperature growth method. An exemplary low temperature growth method is disclosed in European Patent application 06116370.

In a preferred embodiment of the invention the substrate is essentially flat. However, a flat surface does not have to be straight. Instead, it can be formed according to the specific requirements that are set up for the field emission electrode depending on in which type of field emission arrangement that the field emission electrode according to the invention is arranged.

Preferably, the electrical insulation is selected from a group comprising an insulator, a semi-insulator, or a poor insulator. Different types of insulating compounds can be used, such as for example a polymer, a resin, rubber or silicone, for example having different flexibility and/or elasticity. However, other compound are possible. By means of a low temperature growth method it is possible to expand the selection of insulator materials as heat during the growth will not be a great problem. The insulating compound can thus be allowed to depend on desired characteristics for the field emission electrode.

In an alternative embodiment of the invention, the method further comprises the step of etching the exposed first end of the nanostructures. By etching the exposed first end of the nanostructures, it is possible to achieve sharp tips which will further enhance the emission of electrons.

In another preferred embodiment, the step of providing an electrical connective member comprises the step of providing a plurality of electrical connective members, each connected to a different selection of the nanostructures, thereby allowing different sections of the electrode to be individually addressable. By allowing different sections of the electrode to be individually addressable, it is possible to for example use the field emission electrode in a display screen where each of the different sections corresponds to a pixel, or in a field emission light source where individual control of different sections can allow for the mixing of differently colored light using only one light source. Such a field emission light source could for example be provided for emitting white light having broad wavelength spectra.

According to a further aspect of the invention, there is provided a field-emission display, comprising an electron-emission receptor, a wavelength converting material arranged in the vicinity of the electron-emission receptor, and an electron-emission source, comprising a plurality of ZnO-nanostructures having a first end and a second end, an electrical insulation arranged between and around the ZnO-nanostructures to electrically insulate them from each other, not fully covering the second end of the ZnO-nanostructures, an electrical conductive member connected to the second end of a selection of the ZnO-nanostructures, and a support structure arranged onto of the electrical conductive member, wherein the first end of the ZnO-nanostructures are the end from which the ZnO-nanostructures are allowed to grow from a well defined surface, and the first end of the ZnO-nanostructures are exposed.

This aspect of the invention provides similar advantages as according to the above discussed method for manufacturing of a field emission display, including for example increased lifetime of the filed emission display, for example due to the fact that there will be less of the nanostructures that will be non-height-aligned. Furthermore, by not having to height align the nanostructures using an expensive etching, grinding, or similar method step, it is possible to provide a less expensive end product. The field emission display is preferably manufactured using the method according to the present invention The electrode used in the field emission display according to the present invention can also be usable as an active component in a piezoelectric arrangement such as a nanogenerator. Suitable nanogenerators are for example disclosed in "Direct-Current Nanogenerators Driven by Ultrasonic Waves", Science 316, 102 (207); DOI: 10.1126/science.1139266, Hudong Wang, et. al.

BRIEF DESCRIPTION OF THE DRAWINGS

These and other aspects of the present invention will now be described in more detail, with reference to the appended drawings showing currently preferred embodiments of the invention, in which.

DETAILED DESCRIPTION OF CURRENTLY PREFERRED EMBODIMENTS

Figure 1:
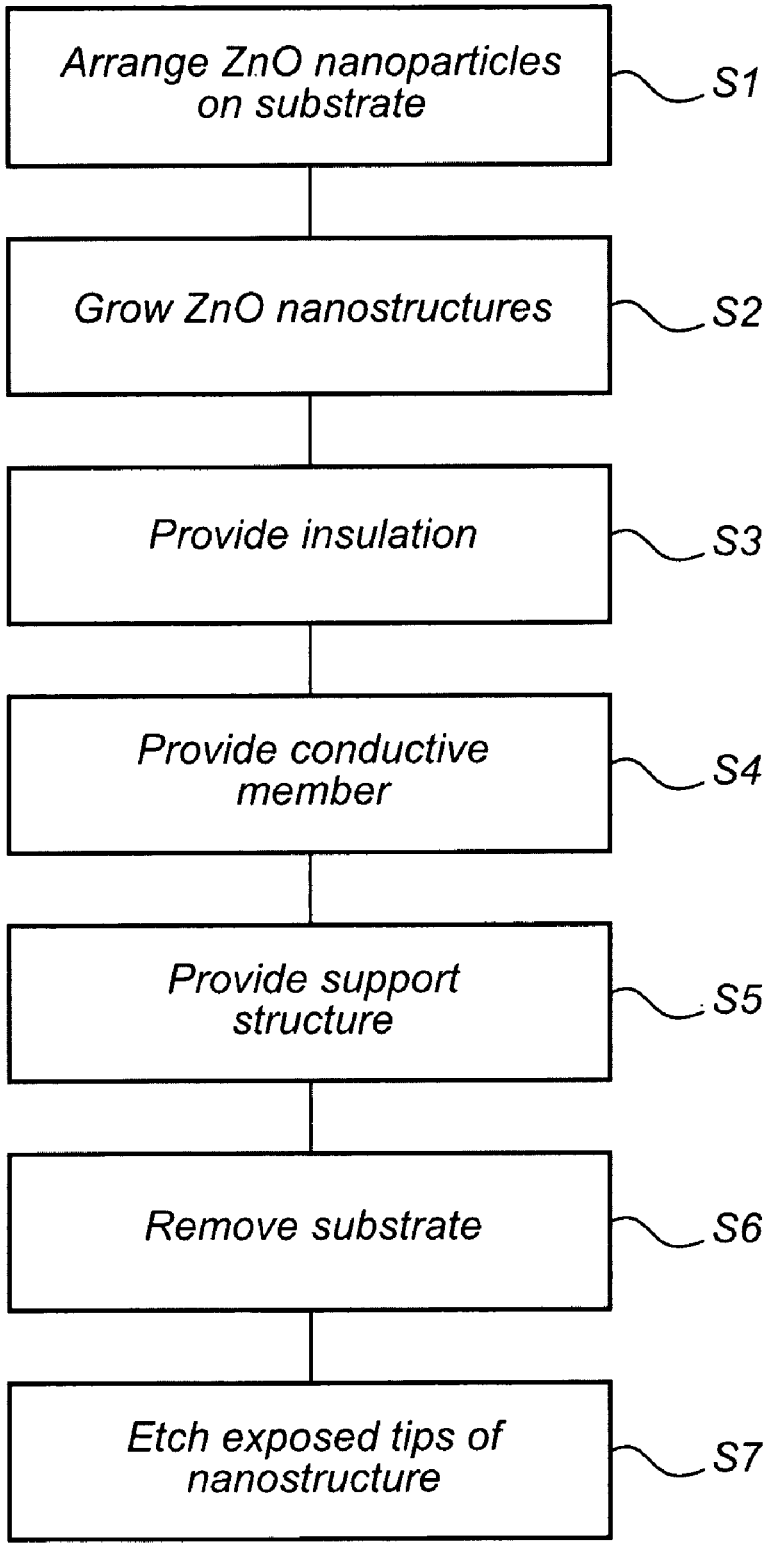
FIG. 1 is a flow chart illustrating the fundamental steps for the manufacturing of a field emission electrode usable in a field emission display according to the present invention.
Figure 2A:
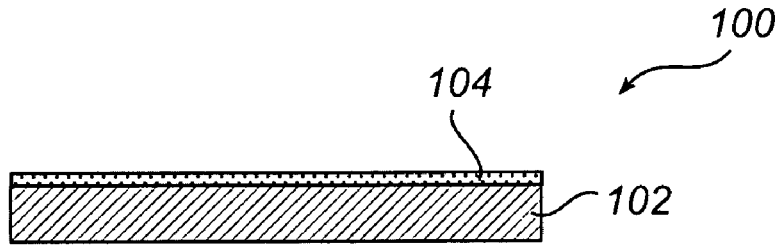
FIGS. 2*a*-2*g* are block diagrams illustrating a field emission electrode manufactured in accordance with the method steps in FIG. 1.
Figure 2B:
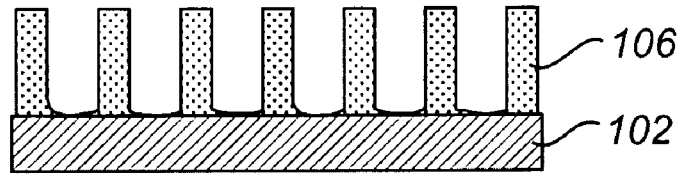
Figure 2C:
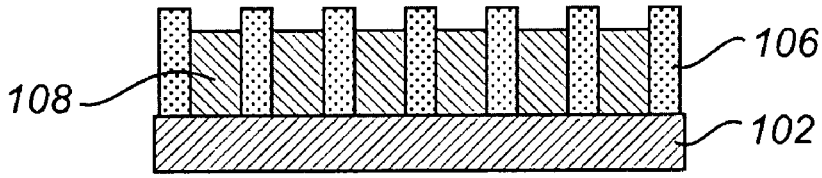
Figure 2D:
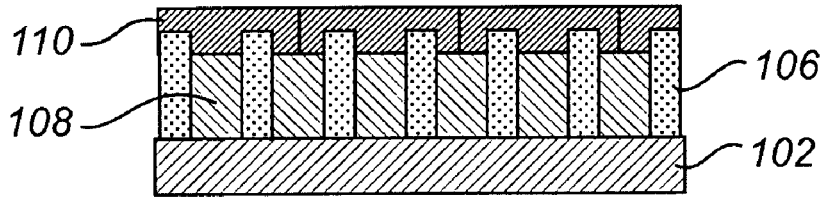
Figure 2E:
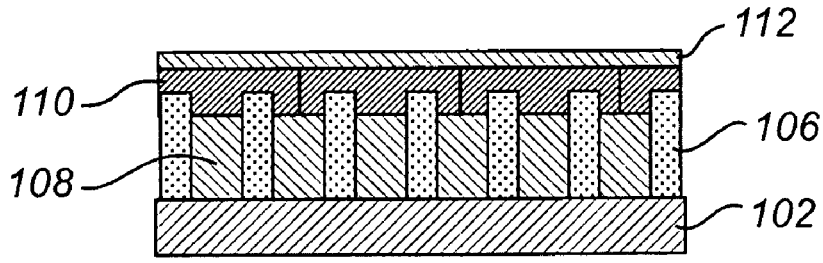
Figure 2F:
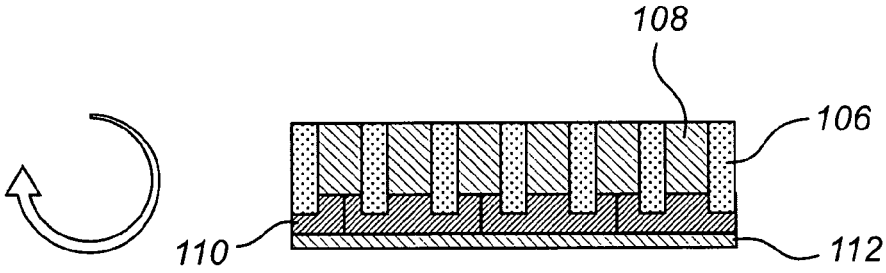
Figure 2G:
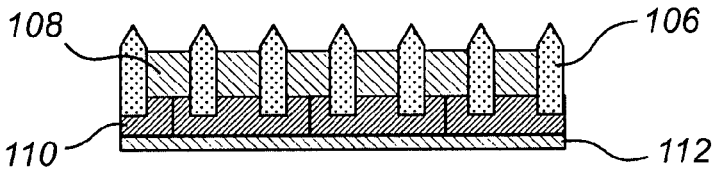

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1 in particular, there is depicted a flowchart illustrating the method steps of manufacturing a field emission electrode 100 usable in a field emission display according to the present invention. Parallel to FIG. 1, FIGS. 2*a*-2*g* visualize the provision of a field emission electrode 100 during the corresponding manufacturing steps illustrated in FIG. 1. Thus parallel references will be given to FIGS. 1 and 2*a*-2*g*.

Initially, in step S1 (FIG. 2*a*), there is provided a substrate 102 onto which it is arranged, randomly or according to a predetermined order, a plurality of ZnO nanoparticles 104. Methods for arranging the ZnO nanoparticles 104 on the substrate 102 include for example chemical vapor deposition (CVD), or one of its variants, such as plasma-enhanced chemical vapor deposition (PECVD). Also, other different metal or metal oxide nanoparticles, instead of or together with the ZnO nanoparticles 104 are possibly arranged onto the substrate 102. The surface of the substrate 102 is preferably essentially flat, i.e. having a very low degree of roughness. In the illustrated embodiment the substrate 102 is straight, however, according to the invention the substrate 102 can have any predefined form, such as for example be curved according to a predefined form.

In step S2 (FIG. 2*b*) the plurality of ZnO nanoparticles 104 is arranged in an environment where they are grown to form ZnO nanostructures 106. Different growth methods are known in the art, and preferably a low temperature growth method is used. Other growth methods include for example Vapor-Liquid-Solid (VLS) synthesis. The ZnO nanostructures 106 are preferably nanotubes, nanorods or nanowires, however, other possible types of nanostructures comprised in the invention includes for example nanospheres and nanofibers.

In step S3 (FIG. 2*c*), generally after the completion of the formation of the ZnO nanostructures 106, there is provided an insulation material 108 that is arranged to essentially electrically insulate the ZnO nanostructures 106 from each other. The electrical insulation 108 is preferably selected from a group comprising an insulator, a semi-insulator, or a poor insulator. Furthermore, the insulator 108 is selected to be one of a rigid or a flexible insulator, thus providing different features to the end product. Different resins, polymers, or rubber materials are useful as the electrical insulator 108. A small portion of the nanostructures 106 are allowed to "surface" above the insulator 108, i.e. the insulator 108 is arranged between and around the nanostructures 104 but does not fully cover the end facing away from the substrate 102 (also above referred to as the second end).

In step S4 (FIG. 2*d*) at least one electrical conductive member 110 is arranged on top of the insulator and in contact with the end of a selection of the nanostructures 106 facing away from the substrate 102. In the illustrated embodiment, the field emission electrode 100 comprises three electrical conductive members 110, however, any number of electrical conductive members 110 are possible. In the illustrated embodiment, each of the three electrically conductive members 110 are connected to a different portion of the plurality of nanostructures 104. For example, if using the field emission electrode 100 in a lighting module, it can be adequate to use only one electrical conductive member 110, as generally it is desirable to arrange the complete lighting module to emit light. However, if using the field emission electrode 100 in a field emission display, it can be desirable to be able to individually address different sections of the field emission electrode 100.

In step S5 (FIG. 2*e*) a support structure 112 is arranged onto of the electrical conductive member 110, i.e. on top of the electrical conductive member 110. The support structure is selected, similar to the insulator 108, to be either rigid or flexible. That is, it can be desirable to have a flexible field emission electrode 100, and thus it is generally necessary to have both a flexible insulator 108 and a flexible support structure 112. However, it is possible to allow for different combinations of the insulator 108 and the support structure 112 depending on the arrangement in which the electrode according to the present invention is used.

In step S6 (FIG. 2*f*), the substrate 102 is removed, thus exposing the end of the nanostructures 106 that earlier was connected to the substrate 102. Different methods for removing the substrate are known in the art, for example in the case where the substrate is a soft substrate for example made out of plastic, it is possible to dissolve the soft substrate using an appropriate solvent. As the substrate was essentially flat, the nanostructures 106 are now essentially height aligned, where the height alignment is a function of the flatness of the substrate 102.

Finally, in optional and additional step S7 (FIG. 2*g*), the now exposed end/tips on the ZnO nanostructures 106 are etched for providing sharper tips. The presence of sharper tips is desirable when using the field emission electrode 100 in a field emission arrangement such as a field emission display or a field emission lighting system. Thus, there is provided a field emission electrode 100 having ZnO nanostructures that are essentially height aligned, without having to include destructive height alignment steps are used in prior art. The height alignment of the now exposed tips of the ZnO nanostructures (also above referred to as the first end) allows for a high current density and provides for the possibility to obtain a homogeneous and stable electron emission. This due to the fact that the first end of a majority of the nanostructures will be height aligned along a predefined line which results from the predefined surface configuration of the substrate 102.

Figure 3:
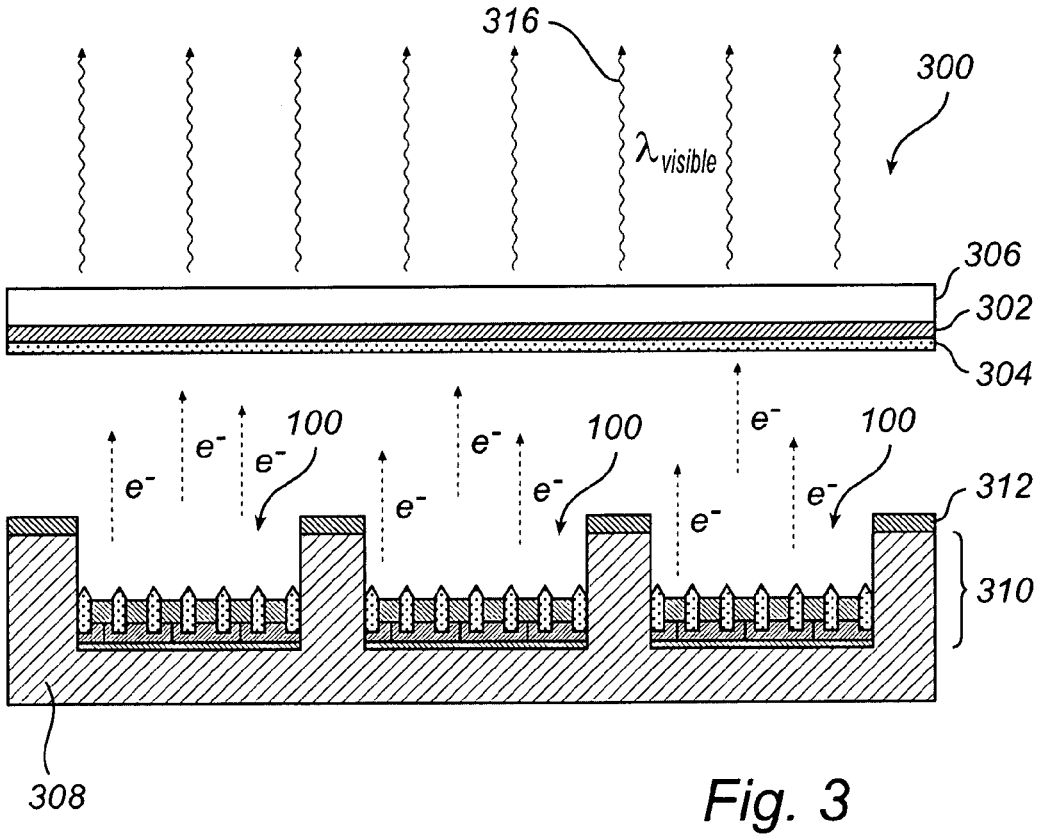
FIG. 3 is a cross-sectional view of a field emission display according to the present invention.

Turning now to FIG. 3 providing a cross-sectional view of a field emission display 300 comprising three field emission electrodes 100, and manufactured in accordance with the novel method according to the present invention. Other possible field emission arrangements include a field emission lighting module. The field emission display 300 further comprises an anode 302, a phosphor layer 304 arranged in the vicinity of the anode 304 (for example a transparent Indium Tin Oxide, ITO, layer or similar), and control logic (not illustrated) for controlling the field emission electrodes 100 and for general control of the field emission display 300. The control logic generally includes a power supply for providing power to the field emission display 300. The field emission arrangement 300 also comprises a transparent cover 306, for example glass, plastic or quartz, which provides a lid to a hermetically sealed field emission display 300, and thereby allows for providing the necessary vacuum environment necessary for the field emission display 300 to operate.

The field emission electrodes 100 are arranged onto a back structure 308 which has protruding structures 310 onto which there on each is provided an electrical connector 312 useful as a gate electrode. During operation, the gate electrodes 312 allows electrons 314 emitted by the field emission electrodes 100 to more easily be emitted from the field emission electrode 100. That is, when a potential difference occurs between the field emission electrode 100 and the anode 302, the phosphor layer 304 is being hit by the electrons 314 from the field emission electrode 100 and caused to emit light 316, which preferably is within the visible wavelength, e.g. white light. However, it is also possible to segment the phosphor layer such that it comprises different sections comprising different phosphor materials arranged to receive electrons 314 and emit different colors.

Furthermore, the skilled addressee realizes that the present invention by no means is limited to the preferred embodiments described above. On the contrary, many modifications and variations are possible within the scope of the appended claims. For example, and as mentioned above, the electrode is not only useful in a field emission arrangement such as a field emission display or a field emission light source, but can also, or instead, be used as an active component in a piezoelectric arrangement.

The invention claimed is:

1. A method for the manufacturing of a field-emission display, comprising the steps of:

arranging an electron-emission receptor in an evacuated chamber;

arranging a wavelength converting material in the vicinity of the electron-emission receptor; and arranging an electron-emission source in the evacuated chamber, the electron-emission source adapted to emit electrons towards the electron-emission receptor, wherein the electron-emission source is formed by:

providing a substrate;

forming a plurality of ZnO-nanostructures on the substrate, wherein the ZnO-nanostructures each have a first end and a second end, and the first end is connected to the substrate;

arranging an electrical insulation between and around the ZnO-nanostructures to electrically insulate the ZnO-nanostructures from each other, partially exposing the second end of the ZnO-nanostructures such that a small portion of the nanostructures is above the electrical insulation;

connecting an electrical conductive member to the second end of a selection of the ZnO-nanostructures;

arranging a support structure onto the electrical conductive member; and removing the substrate, thereby exposing the first end of the ZnO-nanostructures.

2. Method according to claim 1, wherein the step of forming the plurality of nanostructures comprises the steps of arranging a plurality of metal or metal oxide particles on the substrate, and allowing for the plurality of metal or metal oxide particles to grow for forming the ZnO nanostructures.

3. Method according to claim 2, wherein the step of providing an electrical connective member comprises providing a plurality of electrical connective members, each connected to a different selection of the nanostructures.

4. Method according to claim 2, wherein the substrate is essentially flat.

5. Method according to claim 2, wherein the method further comprises the step of etching the exposed first end of the nanostructures.

6. Method according to claim 1, wherein the step of providing an electrical connective member comprises providing a plurality of electrical connective members, each connected to a different selection of the ZnO nanostructures.

7. Method according to claim 6, wherein the plurality of electrical connective members are individually addressable.

8. Method according to claim 7, further comprising providing control logic and connecting the control logic to the field-emission display and the electron emission source.

9. Method according to claim 6, wherein the substrate is essentially flat.

10. Method according to claim 6, wherein the method further comprises the step of etching the exposed first end of the nanostructures.

11. Method according to claim 1, wherein the substrate is essentially flat.

12. Method according to claim 1, wherein the method further comprises the step of etching the exposed first end of the ZnO nanostructures.

13. Method according to claim 1, wherein forming the plurality of ZnO-nanostructures includes depositing the ZnO-nanoparticles on a surface of the substrate.

14. Method according to claim 1, wherein connecting the electrically conductive member includes arranging the electrically conductive member in surface contact with the second end of the ZnO-nanostructures.

15. Method according to claim 1, wherein arranging the electrical insulation includes arranging the electrical insulation in surface contact with the ZnO-nanostructures such that the small portion of the ZnO-nanostructures is above an uppermost surface of the electrical insulation.

16. Method according to claim 1, wherein arranging the support structure includes covering the second end of the ZnO-nanostructure with the support structure.

* * * * *